US010214375B2

(12) United States Patent
Yanagida et al.

(10) Patent No.: US 10,214,375 B2
(45) Date of Patent: Feb. 26, 2019

(54) PAPER SHEET STORAGE DEVICE AND PAPER SHEET STORAGE METHOD

(71) Applicant: FUJITSU FRONTECH LIMITED, Inagi (JP)

(72) Inventors: Hiroshi Yanagida, Inagi (JP); Shohei Koizumi, Inagi (JP); Ryo Fujiwara, Inagi (JP); Tomoyuki Tamahashi, Inagi (JP)

(73) Assignee: FUJITSU FRONTECH LIMITED, Tokyo (JP)

( * ) Notice: Subject to any disclaimer, the term of this patent is extended or adjusted under 35 U.S.C. 154(b) by 0 days.

(21) Appl. No.: 15/637,679

(22) Filed: Jun. 29, 2017

(65) Prior Publication Data

US 2017/0297844 A1 Oct. 19, 2017

Related U.S. Application Data

(63) Continuation of application No. PCT/JP2015/050537, filed on Jan. 9, 2015.

(51) Int. Cl.
*G07D 11/00* (2006.01)
*B65H 7/18* (2006.01)
(Continued)

(52) U.S. Cl.
CPC ..... *B65H 7/18* (2013.01); *B65H 7/02* (2013.01); *B65H 29/46* (2013.01); *B65H 29/52* (2013.01);
(Continued)

(58) Field of Classification Search
CPC ..... G07D 11/00; G07D 11/0003; G07D 11/0006; G07D 11/0009; G07D 11/0012;
(Continued)

(56) References Cited

U.S. PATENT DOCUMENTS 4,790,476 A * 12/1988 Tanaka ..... E05G 1/005 232/1 D
5,465,948 A * 11/1995 Weller ..... B65H 3/5261 271/121
(Continued)

FOREIGN PATENT DOCUMENTS

FR 2453811 A1 * 11/1980 ..... G07F 7/04
JP 54-3995 6/1977
(Continued)

OTHER PUBLICATIONS

English Translation of JP6013181 Y2 (Year: 1994).*
(Continued)

*Primary Examiner* — Jeffrey A Shapiro
(74) *Attorney, Agent, or Firm* — Staas & Halsey LLP

(57) ABSTRACT

A banknote storage device includes a housing member having a loading region in which a banknote is loaded; a storage which is disposed to be adjacent to the housing member and in which the banknote is stored; a temporary accumulation region provided between the loading region and the storage so as to temporarily accumulate the banknote to be stored in the storage; and a push-in mechanism that pushes the banknote loaded to the loading region, into the temporary accumulation region and that pushes a plurality of the banknotes accumulated in the temporary accumulation region, into the storage.

6 Claims, 13 Drawing Sheets

(51) Int. Cl.

| | |
|---|---|
| ***B65H 29/46*** | (2006.01) |
| ***B65H 31/06*** | (2006.01) |
| ***G07D 9/00*** | (2006.01) |
| ***B65H 7/02*** | (2006.01) |
| ***B65H 29/52*** | (2006.01) |
| *B65H 7/00* | (2006.01) |

(52) U.S. Cl.

CPC ..... *B65H 31/06* (2013.01); *G07D 9/00* (2013.01); *G07D 11/0003* (2013.01); *G07D 11/0021* (2013.01); *G07D 11/0027* (2013.01); *G07D 11/0033* (2013.01); *B65H 7/00* (2013.01); *B65H 2301/4213* (2013.01); *B65H 2301/4214* (2013.01); *B65H 2301/4227* (2013.01); *B65H 2301/4452* (2013.01); *B65H 2404/2691* (2013.01); *B65H 2405/214* (2013.01); *B65H 2701/1912* (2013.01)

(58) Field of Classification Search

CPC ..... G07D 11/0015; G07D 11/0021; G07D 11/11; G07D 11/0024; G07D 11/0027; G07D 11/003; G07D 11/0033; G07D 11/0084; G07D 11/0087; G07D 13/00; G07D 2211/00; G07F 7/00; G07F 7/005; G07F 7/04; G07F 19/00; G07F 19/20; G07F 19/201; G07F 19/202; G07F 19/203; B65H 29/46; B65H 2404/64; B65H 7/18; B65H 31/06; B65H 7/02; B65H 29/52; B65H 7/00; B65H 2301/4452; B65H 2404/2691; B65H 2301/4213; B65H 2301/4214; B65H 2301/4227; B65H 2405/214; B65H 2701/1912

USPC ..... 194/206, 207; 209/534; 235/379; 271/180, 181

See application file for complete search history.

(56) References Cited

U.S. PATENT DOCUMENTS

| | | | | |
|---|---|---|---|---|
| 6,065,746 | A * | 5/2000 | Tranquilla | B65H 29/68 193/32 |
| 7,841,459 | B2 * | 11/2010 | Isobe | B65H 29/46 194/206 |
| 7,913,830 | B2 * | 3/2011 | Lee | B65H 29/46 194/206 |
| 2003/0180131 | A1 * | 9/2003 | Lewis | G07D 11/0009 414/411 |
| 2004/0217536 | A1 * | 11/2004 | Isobe | B65H 29/46 271/3.14 |
| 2005/0189702 | A1 * | 9/2005 | Takeuchi | B65H 29/18 271/180 |
| 2008/0060906 | A1 * | 3/2008 | Fitzgerald | G07D 11/0081 194/207 |
| 2009/0107798 | A1 * | 4/2009 | Nireki | G07F 7/04 194/206 |
| 2009/0159552 | A1 * | 6/2009 | Cano-Pey | B65D 47/0828 215/235 |
| 2010/0059417 | A1 * | 3/2010 | Lee | B65H 29/46 209/534 |

FOREIGN PATENT DOCUMENTS

| | | | | |
|---|---|---|---|---|
| JP | 54-58494 | | 5/1979 | |
| JP | 55-130447 | | 10/1980 | |
| JP | 57-81050 | | 5/1982 | |
| JP | 61-81364 | | 4/1986 | |
| JP | 6013181 | Y2 * | 7/1986 | B65H 29/46 |
| JP | 2004-107079 | | 4/2004 | |
| JP | 2008-308324 | | 12/2008 | |
| JP | 2012-64198 | | 3/2012 | |
| WO | WO2010064310 | A1 * | 6/2010 | G07D 11/0012 |

OTHER PUBLICATIONS

English Translation of FR 2453811 A1 (Year: 1980).*

English Translation of WO2010064310 A1 (Year: 2010).*

International Search Report dated Apr. 14, 2015 in corresponding International Patent Application No. PCT/JP2015/050537.

Written Opinion of the International Searching Authority dated Apr. 14, 2015 in corresponding International Patent Application No. PCT/JP2015/050537.

* cited by examiner

PAPER SHEET STORAGE DEVICE AND PAPER SHEET STORAGE METHOD

CROSS-REFERENCE TO RELATED APPLICATION

This application is a continuation application of International Application PCT/JP2015/050537, filed on Jan. 9, 2015 and designating the U.S., the entire contents of which are incorporated herein by reference.

FIELD

The present invention relates to a paper sheet storage device and a paper sheet storage method.

BACKGROUND

A banknote handling device such as an automated teller machine (ATM) includes a banknote storage device that stores and accumulates loaded banknotes in order to collect the banknotes finally from the banknote handling device. As this type of banknote storage device, a configuration in which a bladed wheel disposed in a loading path of banknotes is rotated to load the banknotes into a storage so that the banknotes are stacked and stored in the storage is known.

Patent Literature 1: Japanese Laid-Open Patent Publication No. 2004-107079

Patent Literature 2: Japanese Laid-Open Patent Publication No. 2008-308324

Patent Literature 3: Japanese Laid-Open Patent Publication No. 2012-64198

In the above-described banknote storage device, since banknotes loaded into the storage are stacked by gravity, the banknotes stored in the storage are not appropriately accumulated due to the charged banknotes repelling each other in the storage, for example.

Therefore, such a configuration as illustrated in FIG. 8 is proposed in order to appropriately accumulate the banknotes stored in the storage. FIG. 8 is a plan view for describing a banknote storage device according to a related art of the present application.

As illustrated in FIG. 8, a banknote storage device 111 according to the related art includes a housing member 112, a storage 113, and a push-in mechanism 118. The housing member 112 has a bottom plate 112*a* in which a loading region 116 in which banknotes 102 are loaded is formed. The storage 113 is disposed to be adjacent to the housing member 112 in a horizontal direction. Moreover, the storage 113 has a storage opening 113*b* which is formed in a side wall 113*a* adjacent to the loading region 116 and in which the banknotes 102 are pushed, and the banknotes 102 are stored from the storage opening 113*b*. The push-in mechanism 118 includes a push-in member 131 that pushes the banknotes 102 loaded to the loading region 116 into the storage 113 and a crosslink member 132 that drives the push-in member 131. Moreover, the storage 113 includes a pressing member 125 that presses the banknotes 102 toward the side wall 113*a* and a coil spring 126 that biases the pressing member 125 in order to accumulate the banknotes stored therein.

In the banknote storage device 111 having such a configuration, the banknotes 102 pushed in from the storage opening 113*b* by the push-in member 131 are sandwiched between the push-in member 131 and the pressing member 125. The banknotes 102 are pressed toward the side wall 113*a* by the pressing member 125 whereby the banknotes 102 are appropriately accumulated in the storage 113.

However, in the above-described banknote storage device 111, the banknotes 102 loaded to the loading region 116 are stored in the storage 113 by the push-in mechanism 118 one by one. Due to this, it takes a considerable amount of processing time to store the banknotes 102 loaded to the loading region 116 of the housing member 112 in the storage 113.

SUMMARY

According to an aspect of the embodiments, a paper sheet storage device includes: a housing member having a loading region in which a paper sheet is loaded; a storage member which is disposed to be adjacent to the housing member and in which the paper sheet is stored; a temporary accumulation region provided between the loading region and the storage member so as to temporarily accumulate the paper sheet to be stored in the storage member; and a push-in mechanism that pushes the paper sheet loaded to the loading region, into the temporary accumulation region and that pushes a plurality of the paper sheets accumulated in the temporary accumulation region, into the storage member.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Hereinafter, a banknote storage device and a banknote storage method according to an embodiment, related to a paper sheet storage device and a paper sheet storage method disclosed in the present application will be described in detail based on the drawings. The paper sheet storage device and the paper sheet storage method disclosed in the present application are not limited to the following embodiments.

Embodiment

[Configuration of Banknote Handling Device]

Figure 1:
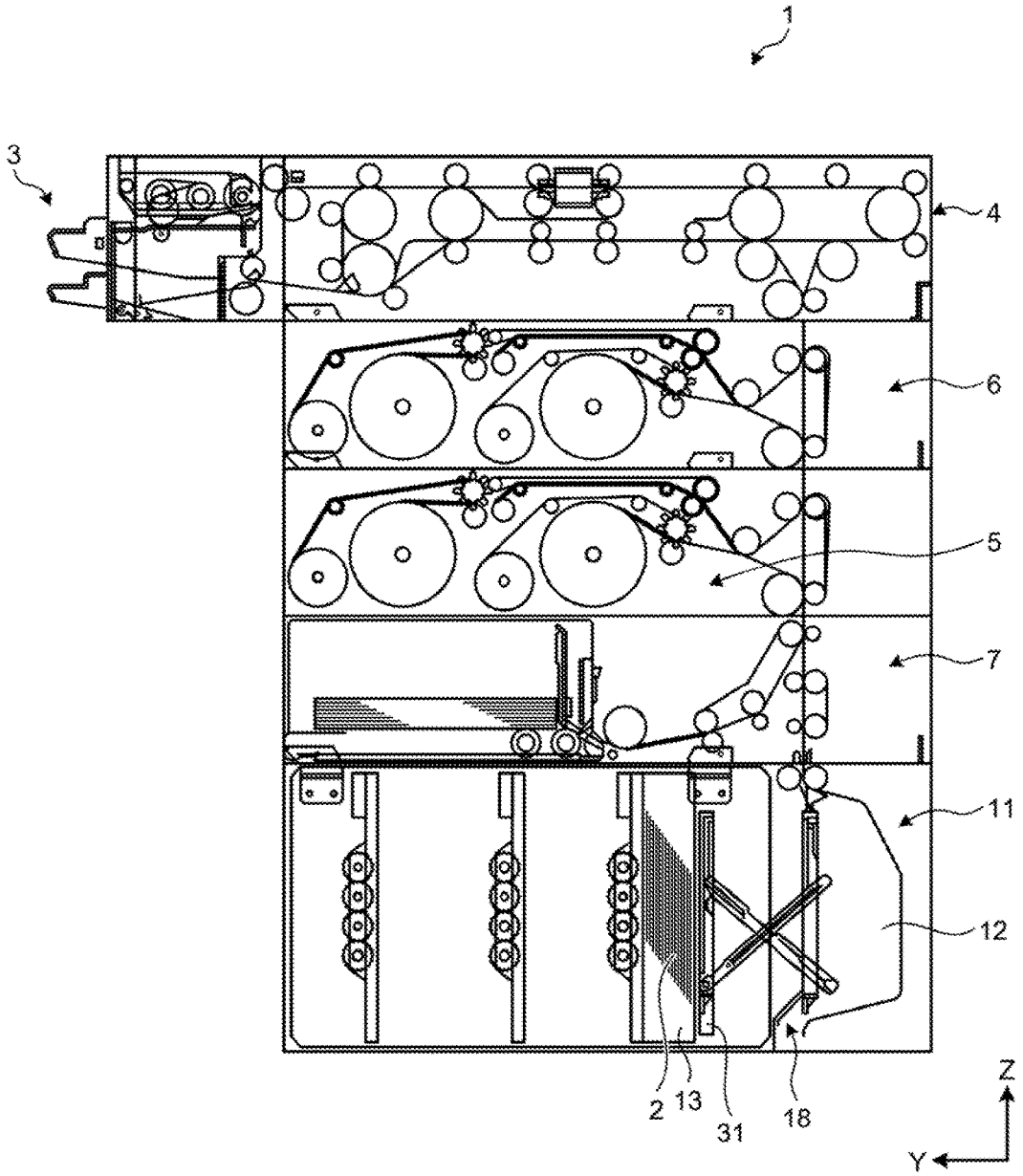
FIG. 1 is a schematic diagram illustrating an entire banknote handling device that includes a banknote storage device according to an embodiment.

FIG. 1 is a schematic diagram illustrating an entire banknote handling device that includes a banknote storage device according to an embodiment. As illustrated in FIG. 1, a banknote handling device 1 according to the embodiment includes a loading and unloading unit 3 that loads and unloads banknotes 2, a discrimination unit 4 that discriminates the banknotes 2 loaded into the loading and unloading unit 3, and a temporary storage unit 5 that temporarily stores the banknotes 2 conveyed from the discrimination unit 4. The banknote handling device 1 further includes a circulation unit 6 that circulates the banknotes 2 stored in the temporary storage unit 5, an unloading unit 7 in which the banknotes 2 to be unloaded are stored, a storage unit 11 that stores the banknotes 2 in a storage 13. The storage unit 11, which is incorporated into the banknote handling device 1, corresponds to the banknote storage device according to the embodiment. In the present embodiment, although the banknote 2 is used as an example of a paper sheet, the paper sheet is not limited to the banknote.

[Configuration of Banknote Storage Device]

Figure 2:
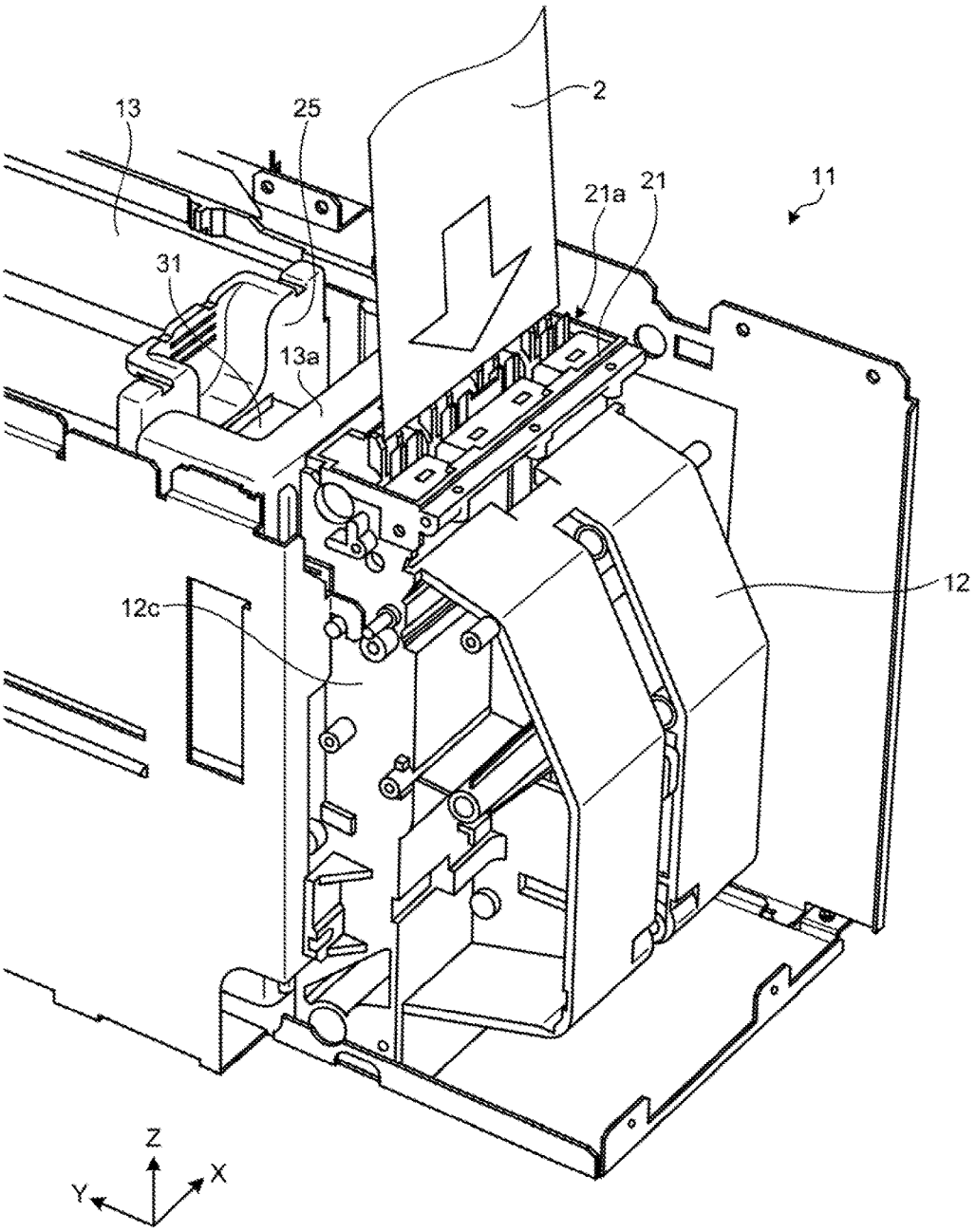
FIG. 2 is a perspective view illustrating the banknote storage device according to the embodiment.
Figure 3:
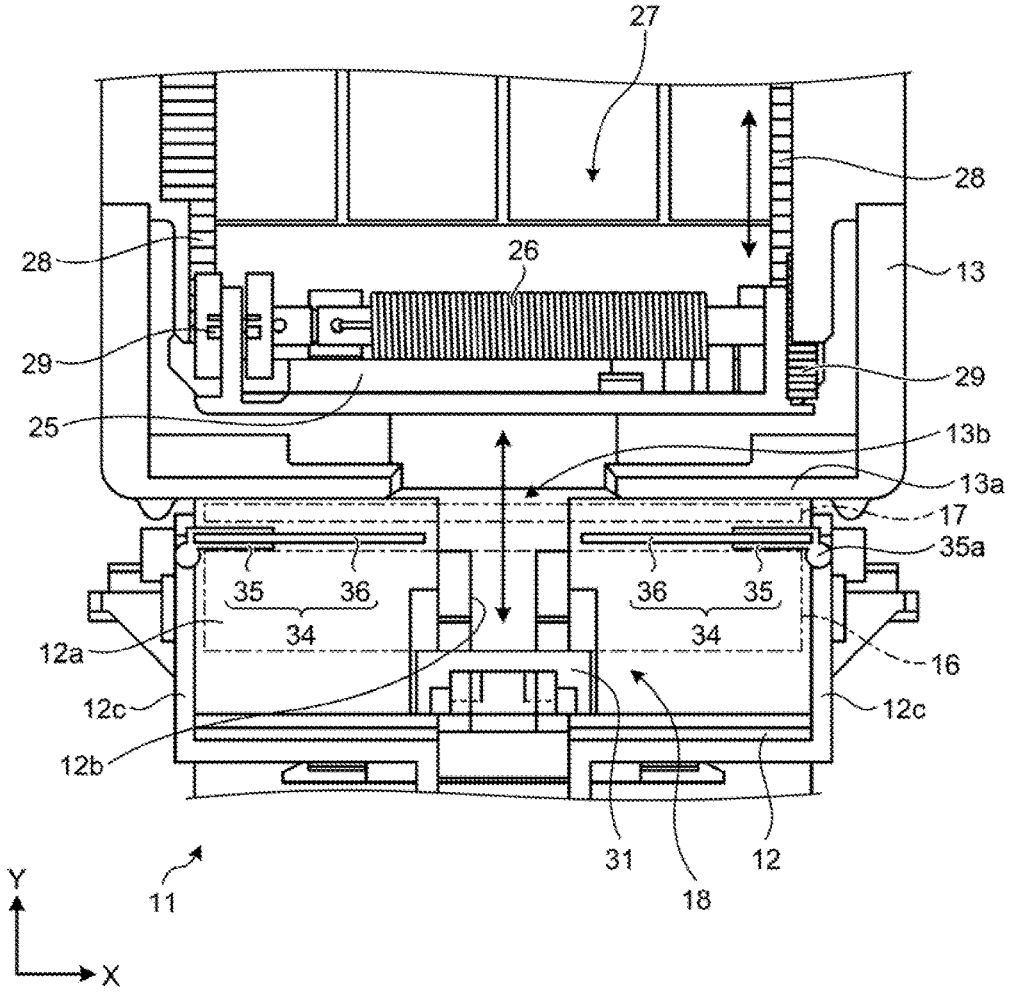
FIG. 3 is a plan view illustrating the banknote storage device according to the embodiment.

FIG. 2 is a perspective view illustrating the banknote storage device according to the embodiment. FIG. 3 is a plan view illustrating the banknote storage device according to the embodiment. In FIGS. 2 and 3, a horizontal direction is illustrated by an X-axis and a Y-axis (the front-rear direction of the banknote storage device) and a vertical direction is illustrated by a Z-axis.

As illustrated in FIGS. 2 and 3, the banknote storage device 11 according to the embodiment, includes a housing member 12, a storage 13 as a storage member, a temporary accumulation region 17, and a push-in mechanism 18. The housing member 12 has a loading region 16 in which the banknotes 2 are loaded. The storage 13 is disposed to be adjacent to the housing member 12 in the Y-direction, and the banknotes 2 are stored in the storage 13. The temporary accumulation region 17 is provided between the loading region 16 and the storage 13, and the banknotes 2 to be stored in the storage 13 are temporarily accumulated in the temporary accumulation region 17. The push-in mechanism 18 pushes all banknotes 2 loaded to the loading region 16 into the temporary accumulation region 17 and pushes a plurality of banknotes 2 accumulated only in the temporary accumulation region 17 into the storage 13.

In the housing member 12, as illustrated in FIGS. 2 and 3, the space that forms the loading region 16 in which the banknotes 2 are loaded, is formed in an approximately box shape which is adjacent to a storage opening 13*b* of the storage 13 to be described later. A guide member 21, which has a loading port 21*a* in which the banknotes 2 are loaded, is provided vertically above the housing member 12. A plurality of guide rollers 22 (see FIG. 4A) that guides the banknotes 2, is provided in the loading port 21*a* of the guide member 21. The guide rollers 22, which are disposed on one side of the loading port 21*a*, are fixed to a spindle 23 and are rotated via a spindle 23 (see FIG. 4A).

The banknotes 2 are conveyed vertically from the upper side toward the guide member 21 on the lower side in a state in which the long side is parallel to the horizontal direction, for example, and are delivered from the loading port 21*a* to the housing member 12 by the guide roller 22. The banknotes 2 delivered to the housing member 12, are loaded to the loading region 16. As illustrated in FIG. 3, a bottom plate 12*a* that supports the long side of the banknote 2, is provided in the loading region 16 of the housing member 12 along the horizontal direction. Due to this, the banknotes 2 loaded to the loading region 16, are supported on the bottom plate 12*a* in such an attitude in which the short side direction is parallel to the vertical direction.

The temporary accumulation region 17 is provided in the housing member 12 to be adjacent to the loading region 16, and the bottom plate 12*a*, which supports the banknote 2, extends from the loading region 16 to the temporary accumulation region 17. In the present embodiment, although the housing member 12 has the temporary accumulation region 17, the present invention is not limited to this configuration. A temporary accumulation member, which has the temporary accumulation region 17, may be disposed between the housing member 12 and the storage 13 as an independent member.

As illustrated in FIGS. 2 and 3, the storage 13 is formed in a box shape that has an approximately rectangular parallelepiped form and is detachably provided in relation to the banknote handling device 1. The storage 13 is removed from the banknote handling device 1 after a predetermined number of banknotes 2 are stored whereby the banknotes 2 are collected. Moreover, the storage 13 has a side wall 13*a* adjacent to the temporary accumulation region 17 of the housing member 12. A storage opening 13*b* in which the banknotes 2 conveyed from the temporary accumulation region 17 are pushed, is provided at the center of the side wall 13*a*. The opening dimension of the storage opening 13*b* is formed to be smaller than the external dimension of the banknote 2. When the banknotes 2 are stored from the storage opening 13*b* into the storage 13, the external dimension of the banknote 2 decreases by being folded into two parts at the center in the longitudinal direction. The banknote 2 is pushed into the storage opening 13*b* in a state of being folded into two parts whereby the banknote 2 is stored inside the storage 13 through the storage opening 13*b*. Since the storage opening 13*b* of the storage 13 is formed to be smaller than the external dimension of the banknote 2, the banknote 2 stored therein is prevented from being removed from the storage opening 13*b*.

The storage 13 has a pressing member 25 that presses the banknotes 2 toward the side wall 13*a*, in order to accumulate the banknotes 2 stored from the storage opening 13*b*. The pressing member 25 is formed in such a size that the pressing member 25 can press the banknote 2 along the longitudinal direction. The pressing member 25 is biased toward the side wall 13*a* by a coil spring 26. Moreover, the storage 13 has a guide mechanism 27 that movably guides the pressing member 25 in a direction toward and away from the side wall 13*a*, which has the storage opening 13*b*. The guide mechanism 27 has a set of guide rails 28, which are formed along the direction toward and away from the side wall 13*a*, and a gear 29, which moves along the guide rail 28. The pressing member 25 is provided across a set of guide rails 28 via the gear 29.

[Configuration of Push-in Mechanism]

Figure 4A:
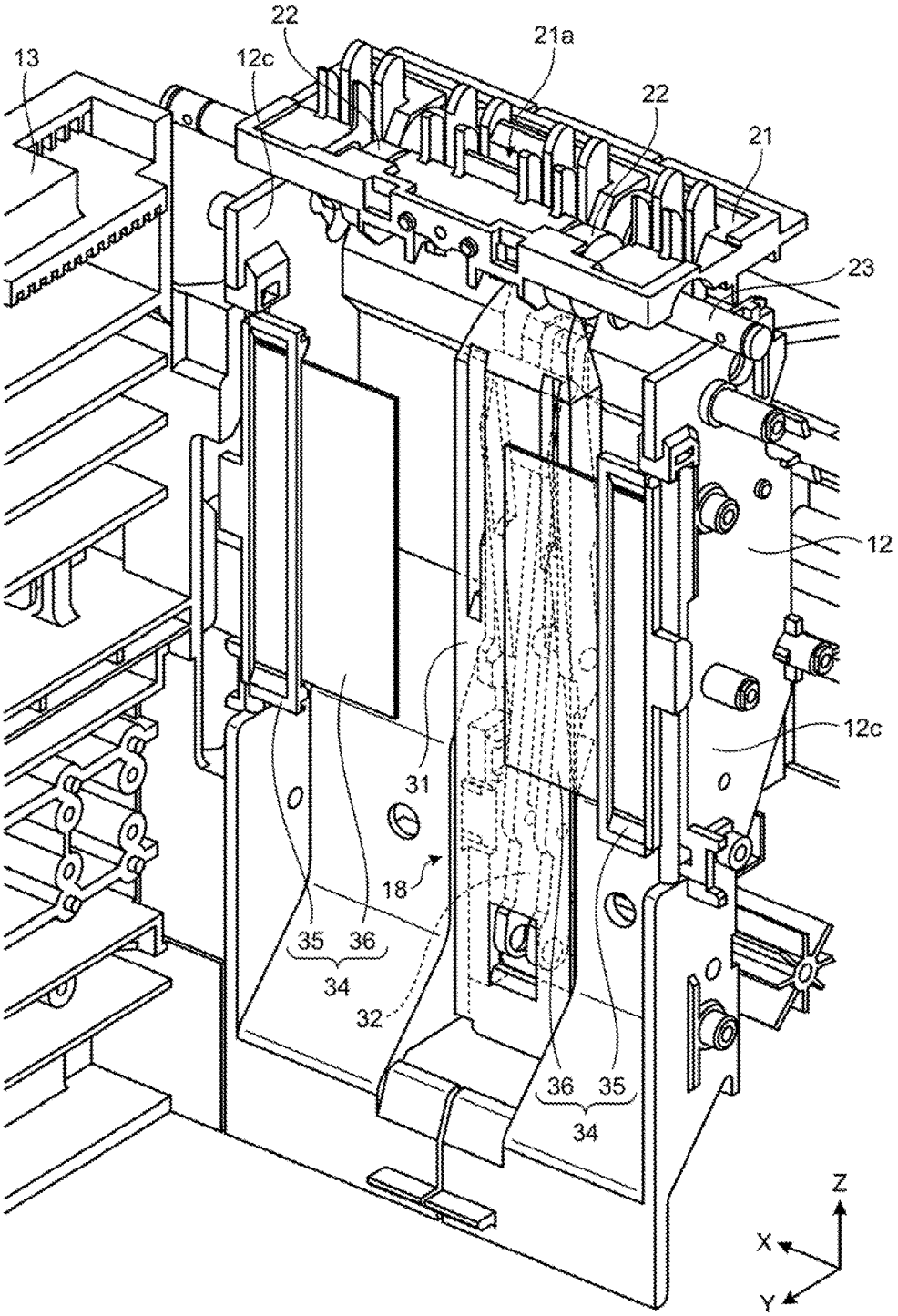
FIG. 4A is a perspective view illustrating a state in which a push-in member is at a standby position in the banknote storage device according to the embodiment.
Figure 4B:
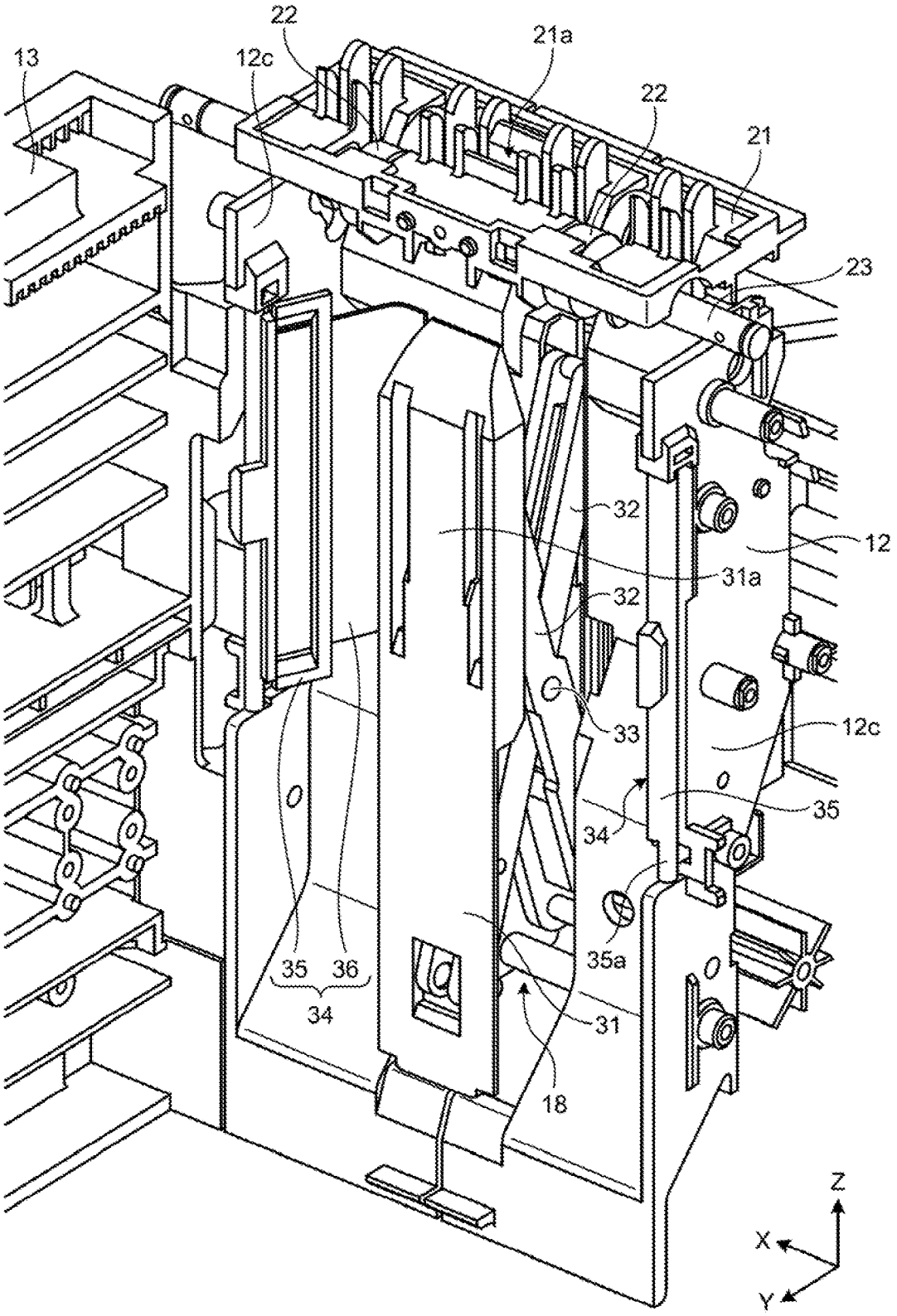
FIG. 4B is a perspective view illustrating a state in which the push-in member moves to a temporary accumulation region in the banknote storage device according to the embodiment.
Figure 4C:
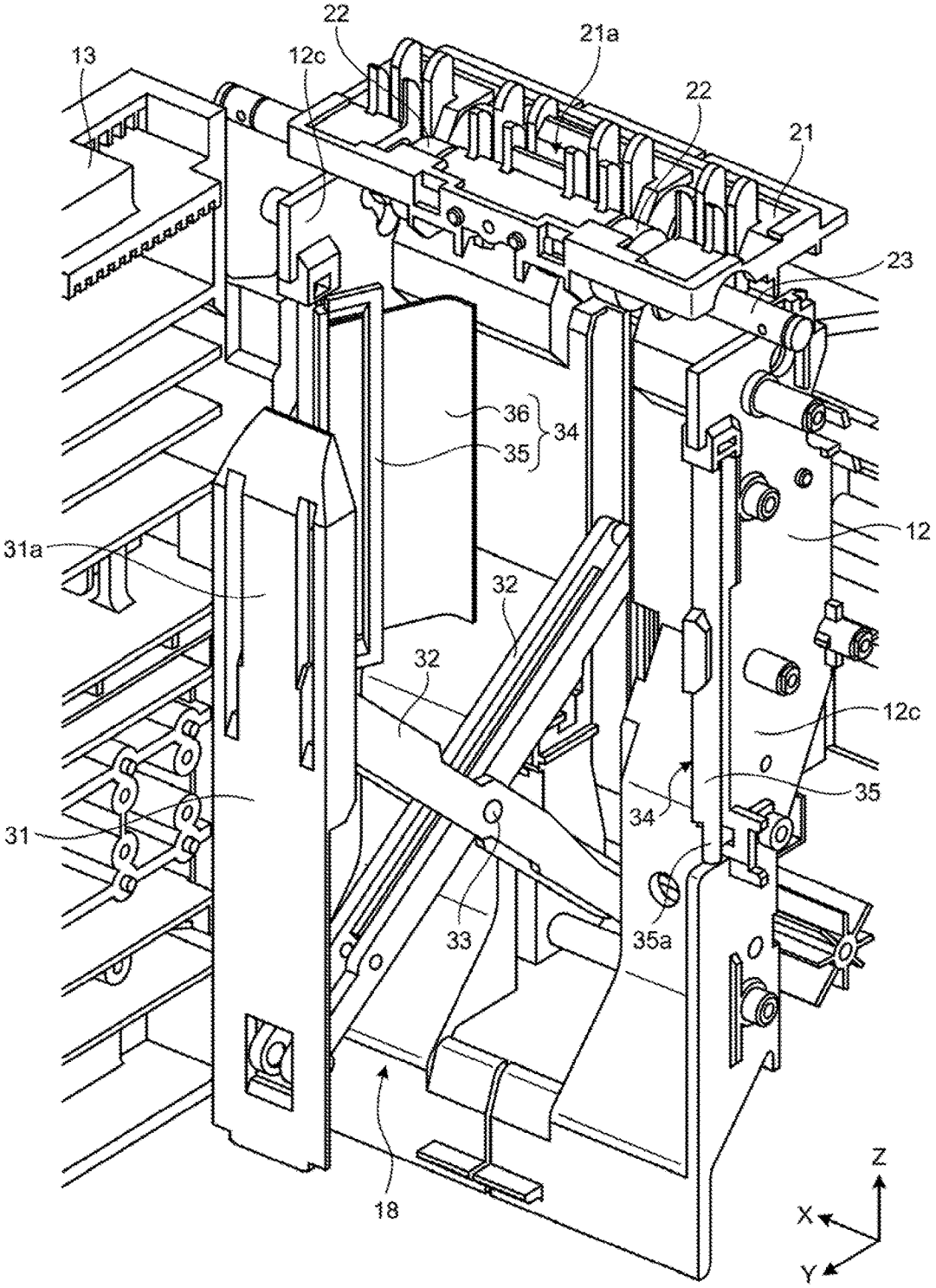
FIG. 4C is a perspective view illustrating a state in which the push-in member moves into a storage in the banknote storage device according to the embodiment.

FIG. 4A is a perspective view illustrating a state in which the push-in member is at a standby position in the banknote storage device 11 according to the embodiment. FIG. 4B is a perspective view illustrating a state in which the push-in member moves toward the temporary accumulation region 17 in the banknote storage device 11 according to the embodiment. FIG. 4C is a perspective view illustrating a state in which the push-in member moves into the storage 13 in the banknote storage device 11 according to the embodiment. In FIGS. 4A, 4B, and 4C, the bottom plate 12*a* of the housing member 12 is not illustrated for the sake of convenience.

As illustrated in FIGS. 4A, 4B, and 4C, the push-in mechanism 18 includes a push-in member 31 for pushing the banknotes 2 loaded to the loading region 16 into the temporary accumulation region 17 and into the storage 13, and includes a set of crosslink members 32 for driving the push-in member 31.

As illustrated in FIG. 3, the push-in member 31 is provided so as to be movable to a standby position at which the push-in member 31 is positioned in the loading region 16, a first advance position at which the push-in member 31 is positioned in the temporary accumulation region 17, and a second advance position at which the push-in member 31 is positioned inside the storage 13.

The external dimension of the push-in member 31 is formed to be smaller than the storage opening 13*b* of the storage 13 so that the push-in member 31 can pass through the storage opening 13*b*. Moreover, as illustrated in FIG. 4C, the push-in member 31 has a push-in surface 31*a* having a rectangular shape which is sufficiently longer than the length of the short side of the banknote 2. Due to this, the push-in member 31 can appropriately push the banknote 2 loaded to the loading region 16 into the temporary accumulation region 17 and into the storage 13.

As illustrated in FIGS. 4B and 4C, one set of crosslink members 32 is pivotably connected by a pivot shaft 33. One end of one of the set of crosslink members 32 is moved by a driving motor (not illustrated) whereby the set of crosslink members 32 extends toward the storage 13. When the set of crosslink members 32 extends, the push-in member 31 is moved from the standby position to the first advance position and the second advance position. Moreover, as illustrated in FIG. 3, a guide slit 12*b*, which allows the push-in member 31 and the set of crosslink members 32 to move, is formed in the bottom plate 12*a* of the temporary accumulation region 17 and the loading region 16.

[Configuration of Partition Member]

As illustrated in FIGS. 3 and 4A, the housing member 12 of the banknote storage device 11 includes a set of partition members 34 that supports the banknote 2 moved to the temporary accumulation region 17. The set of partition members 34 is formed in a planar form, and as illustrated in FIG. 3, are arranged in parallel between the loading region 16 and the temporary accumulation region 17. The set of partition members 34 is provided so as to be pivotable between a partition position, which is a first position, and an open position, which is a second position. At the partition position, the set of partition members 34 partitions the space between the loading region 16 and the temporary accumulation region 17 as illustrated in FIG. 4A. At the open position, the set of partition members 34 opens the space between the loading region 16 and the temporary accumulation region 17 as illustrated in FIG. 4B.

As illustrated in FIGS. 4A and 4B, the set of partition members 34 is pivotably supported by the facing side walls 12*c* of the housing member 12. The set of partition members 34 includes a base end 35, in which a shaft portion 35*a* pivotably supported on the side wall 12*c* of the housing member 12 is formed, and a distal end 36, which is connected to the base end 35. Moreover, the set of partition members 34 is disposed between the facing distal ends 36 at the partition position at a predetermined interval through which the push-in member 31, which moves between the standby position and the first advance position, can pass.

The distal end 36 of the partition member 34 is formed to be elastically deformable. The base end 35 of the partition member 34 is formed in a rectangular frame shape using a rigid member. Since the rigidity of the base end 35 is secured, the stability of the rotation operation around the shaft portion 35*a* is secured. Moreover, the distal end 36 of the partition member 34 is formed in a rectangular plate shape using an elastic member such as a resin film or a rubber plate, for example, and is fixed to the base end 35.

As described above, when the partition member 34 pivots from the partition position to the open position, the distal end 36 of the partition member 34 is smoothly elastically deformed when the distal end 36 makes contact with the push-in member 31 and the banknote 2 so as not to prevent the advancing of the push-in member 31 that moves from the standby position toward the first advance position. Since the distal end 36 is elastically deformed in this manner, the push-in member 31 can stably convey the banknote 2 from the loading region 16 to the temporary accumulation region 17. Furthermore, since the space between the distal ends 36 of the set of partition members 34 is narrow so that the push-in member 31 can pass through the space, the banknote 2 in the temporary accumulation region 17 can be stably held by the distal ends 36.

The set of partition members 34 is configured to interact with the push-in mechanism 18 so that the partition member 34 is pivoted from the partition position to the open position in synchronization with the operation of the push-in member 31 advancing from the standby position to the first advance position. The set of partition members 34 is moved to the open position by the push-in mechanism 18 when the push-in member 31 moves to the first advance position.

In the partition member 34, the base end 35 and the distal end 36 may be formed integrally using the same material, for example, and the thickness of the distal end 36 may be smaller than the base end 35 so that the distal end 36 can be elastically deformed. Moreover, the distal end 36 of the partition member 34 is not limited to the configuration in which the distal end is formed of an elastic material. For example, the set of partition members 34 may be disposed at such an interval that the distal end 36 does not make contact with the push-in member 31, which advances toward the first advance position, when the partition member 34 pivots from the partition position to the open position. In this case, the base end 35 and the distal end 36 of the partition member 34 may be formed integrally using a rigid member.

Although not illustrated in the drawings, the set of partition members 34 is not limited to the configuration in which the partition member pivots. The set of partition members 34 may be configured so as to be slidable between the loading region 16 and the temporary accumulation region 17 in a direction in which the distal ends 36 move closer to or away from each other. Moreover, the set of partition members 34 may be configured to move up and down in relation to the bottom plate 12*a* of the housing member 12 and it is possible to prevent the set of partition members 34 and the push-in member 31 from passing each other when the partition member moves between the partition position and the open position. Furthermore, in this configuration, it is possible to use one partition member disposed across between the loading region 16 and the temporary accumulation region 17 and to enhance the stability of the holding state of the banknote 2 in the temporary accumulation region 17.

[Banknote Storing Operation]

Figure 5:
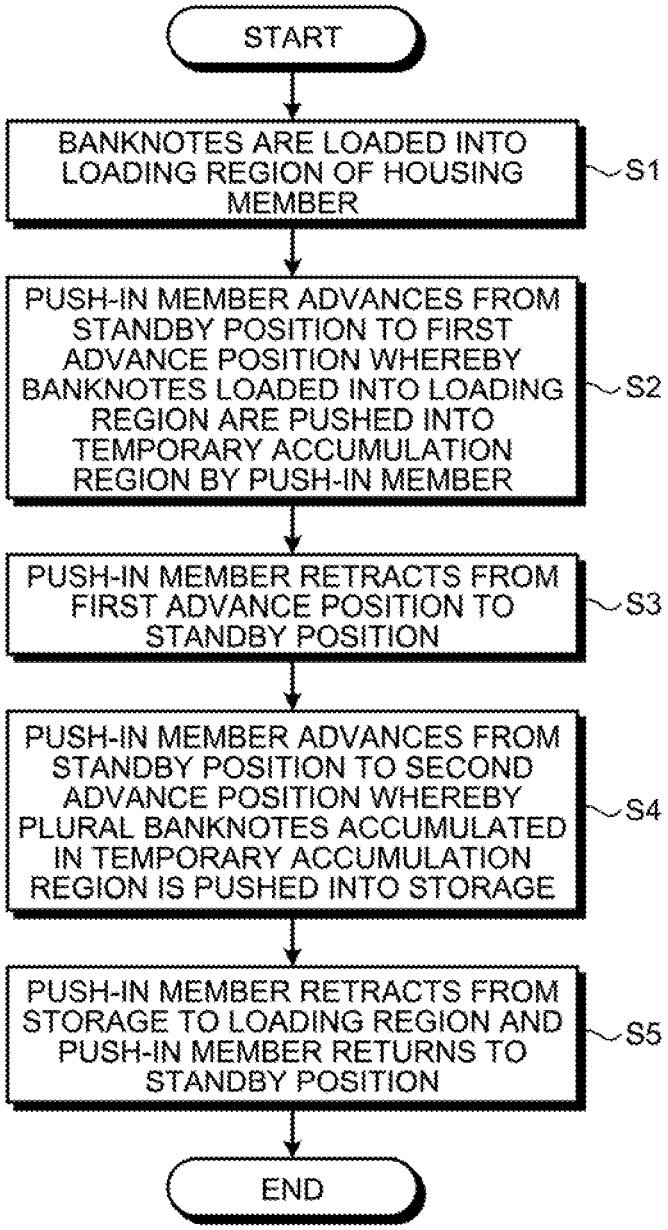
FIG. 5 is a flowchart for describing a storing operation of the banknote storage device according to the embodiment.
Figure 6A:
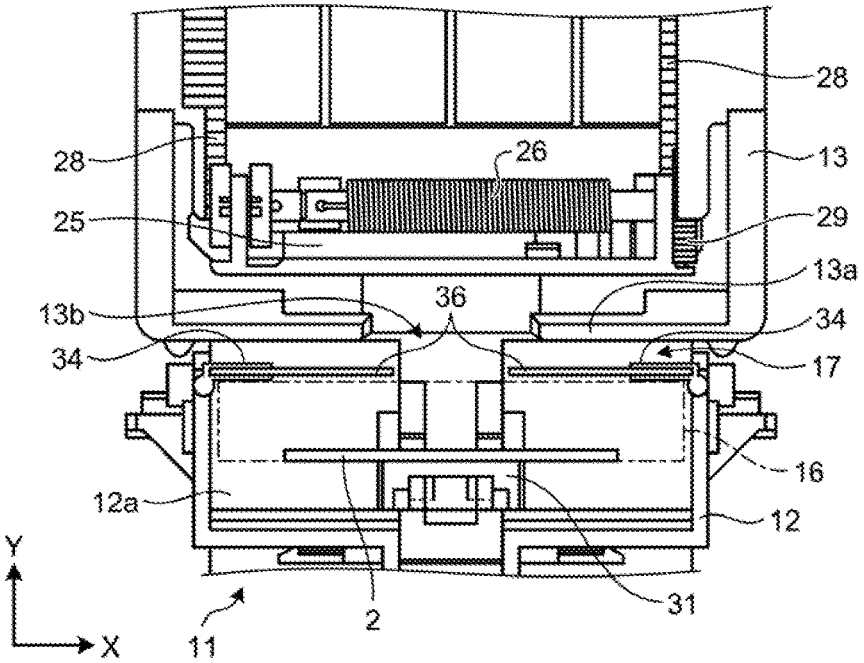
FIG. 6A is a plan view illustrating a state in which a banknote is loaded to a loading region in the banknote storage device according to the embodiment.
Figure 6B:
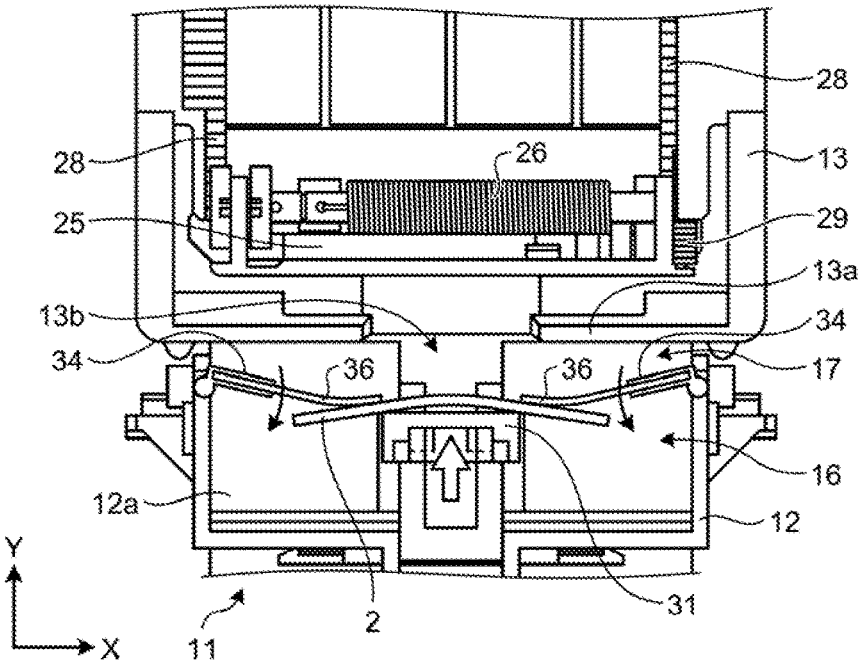
FIG. 6B is a plan view illustrating a state in which a banknote is moved by the push-in member in the banknote storage device according to the embodiment.
Figure 6C:
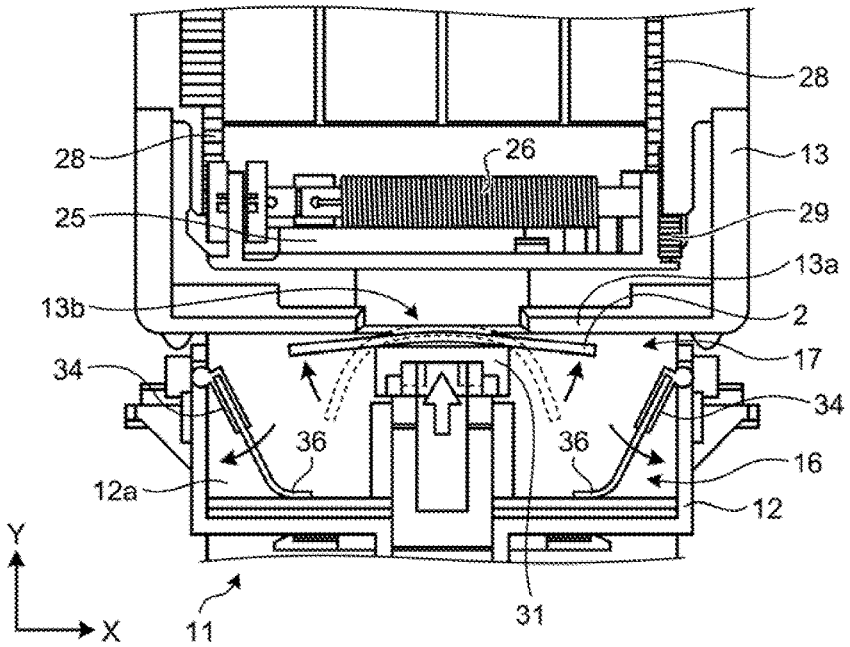
FIG. 6C is a plan view illustrating a state in which a banknote is moved to the temporary accumulation region by the push-in member in the banknote storage device according to the embodiment.
Figure 6D:
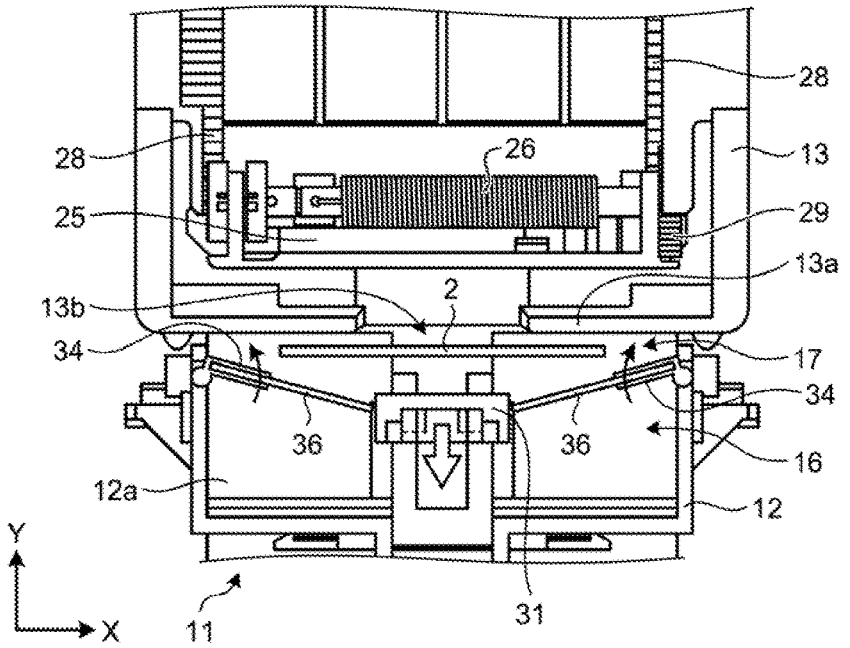
FIG. 6D is a plan view illustrating a state in which the push-in member retracts up to a standby position in the banknote storage device according to the embodiment.
Figure 6E:
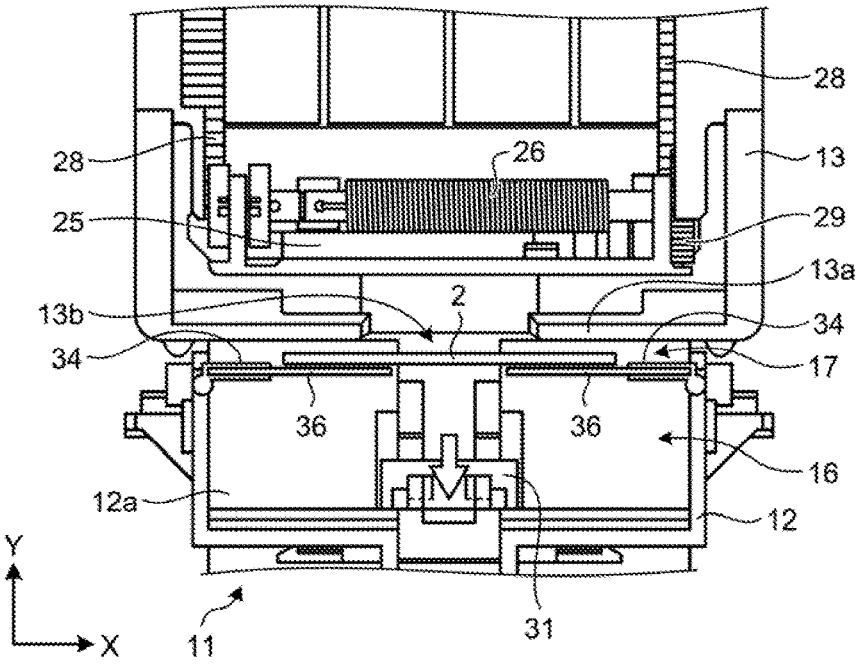
FIG. 6E is a plan view illustrating a state in which the push-in member returns to the standby position in the banknote storage device according to the embodiment.

FIG. 5 is a flowchart for describing a storing operation of the banknote storage device 11 according to the embodiment. FIG. 6A is a plan view illustrating a state in which the banknote 2 is loaded to the loading region 16 in the banknote storage device 11 according to the embodiment. FIG. 6B is a plan view illustrating a state in which the banknote 2 is moved by the push-in member 31 in the banknote storage device 11 according to the embodiment. FIG. 6C is a plan view illustrating a state in which the banknote 2 is moved to the temporary accumulation region 17 by the push-in member 31 in the banknote storage device 11 according to the embodiment. FIG. 6D is a plan view illustrating a state in which the push-in member 31 retracts to the standby position in the banknote storage device 11 according to the embodiment. FIG. 6E is a plan view illustrating a state in which the push-in member 31 returns to the standby position in the banknote storage device 11 according to the embodiment.

As illustrated in FIG. 6A, the banknote 2 entering from the loading port 21*a* of the guide member 21 is loaded to the loading region 16 of the housing member 12 (step S1 in FIG. 5). In this case, one surface of the banknote 2 is supported on the bottom plate 12*a* of the loading region 16 in a state of being in contact with the push-in member 31 at the standby position. Subsequently, as illustrated in FIG. 6B, the push-in member 31 advances from the standby position to the first advance position whereby the entire banknote 2 loaded to the loading region 16, is moved by being pushed toward the temporary accumulation region 17. In this case, the set of partition members 34 is pivoted from the partition position toward the open position in synchronization with the advancing operation of the push-in member 31.

In the course in which the push-in member 31 moves from the standby position to the first advance position, the distal ends 36 of the set of partition members 34 are elastically deformed while making contact with both sides in the longitudinal direction of the banknote 2 conveyed by the push-in member 31. The long side of the banknote 2 is curved while being moved to the temporary accumulation region 17 when the distal ends 36 of the set of partition members 34 make contact with the banknote 2. As a result, the banknote 2 passes between the distal ends 36 of the set of partition members 34 in a curved state and advances into the temporary accumulation region 17.

As illustrated in FIG. 6C, the push-in member 31 passes between the distal ends 36 of the set of partition members 34 and advances up to the first advance position. In this way, the push-in member 31 pushes the banknote 2 loaded to the loading region 16 into the temporary accumulation region 17 (step S2 in FIG. 5). When the banknote 2, which is curved when passing between the distal ends 36 of the set of partition members 34, is conveyed to the temporary accumulation region 17, the long side thereof is expanded to return to a straight state. Moreover, when the push-in member 31 is moved to the first advance position, the set of partition members 34 pivot to the open position. The partition member 34, which is pivoted to the open position, stops in a state, in which the distal end 36 is pressed against the housing member 12.

After the banknote 2 is conveyed to the temporary accumulation region 17, as illustrated in FIG. 6D, the push-in member 31 retracts from the first advance position toward the standby position. The set of partition members 34 pivots from the open position toward the partition position, in synchronization with the operation of the push-in member 31 retracting from the first advance position. The push-in member 31 passes between the distal ends 36 of the set of partition members 34 returning to the partition position, and the push-in member 31 retracts from the first advance position to the standby position as illustrated in FIG. 6E (step S3 in FIG. 5). When the push-in member 31 returns to the standby position, the set of partition members 34 returns from the open position to the partition position. Moreover, the set of partition members 34, which is returned to the partition position, holds the banknote 2, which is conveyed to the temporary accumulation region 17, and prevents the banknote 2 in the temporary accumulation region 17 from moving to the loading region 16.

Figure 6F:
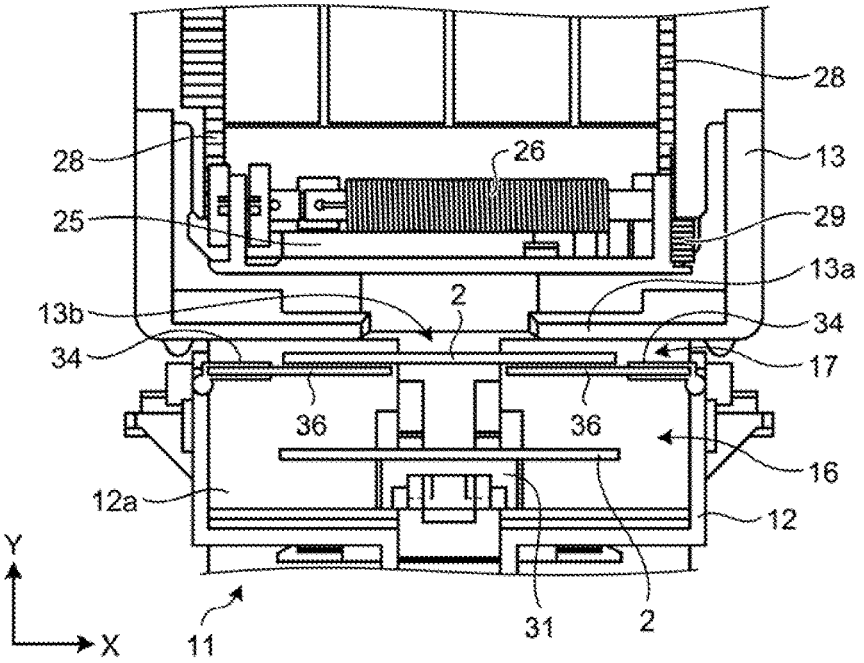
FIG. 6F is a plan view illustrating a state in which a subsequent banknote is loaded to the loading region in the banknote storage device according to the embodiment.
Figure 6G:
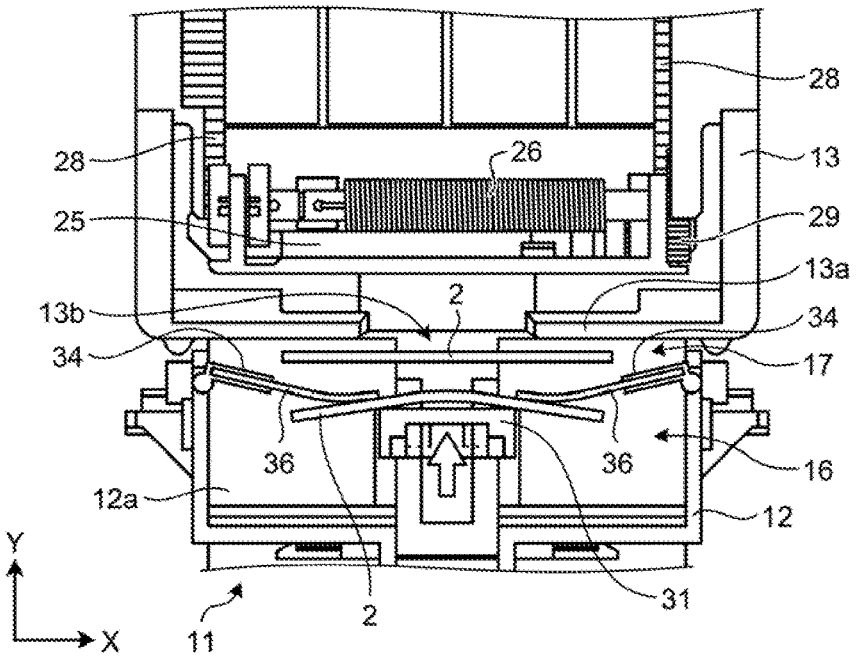
FIG. 6G is a plan view illustrating a state in which a subsequent banknote is moved to the temporary accumulation region by the push-in member in the banknote storage device according to the embodiment.
Figure 6H:
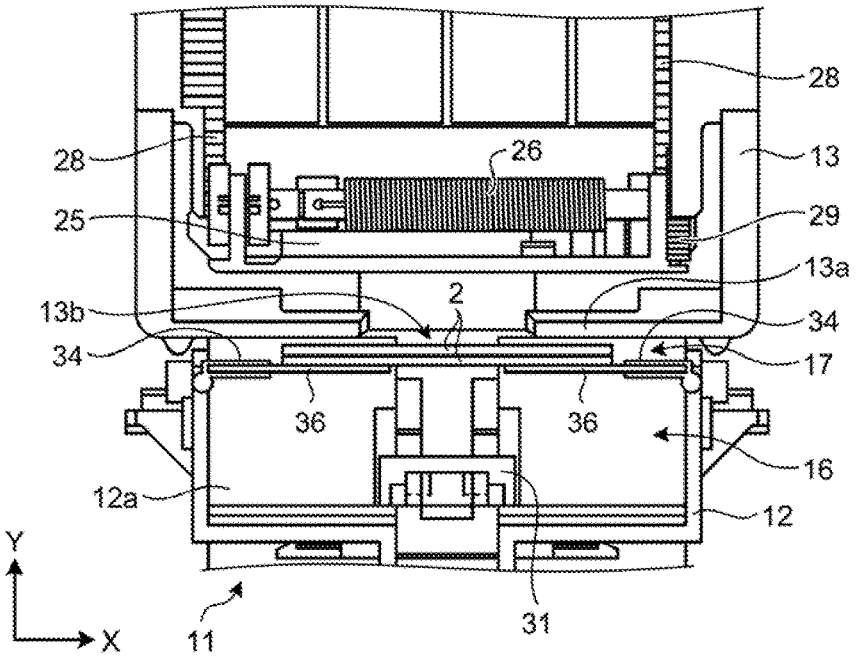
FIG. 6H is a plan view illustrating a state in which a subsequent banknote is accumulated in the temporary accumulation region by the push-in member in the banknote storage device according to the embodiment.
Figure 7A:
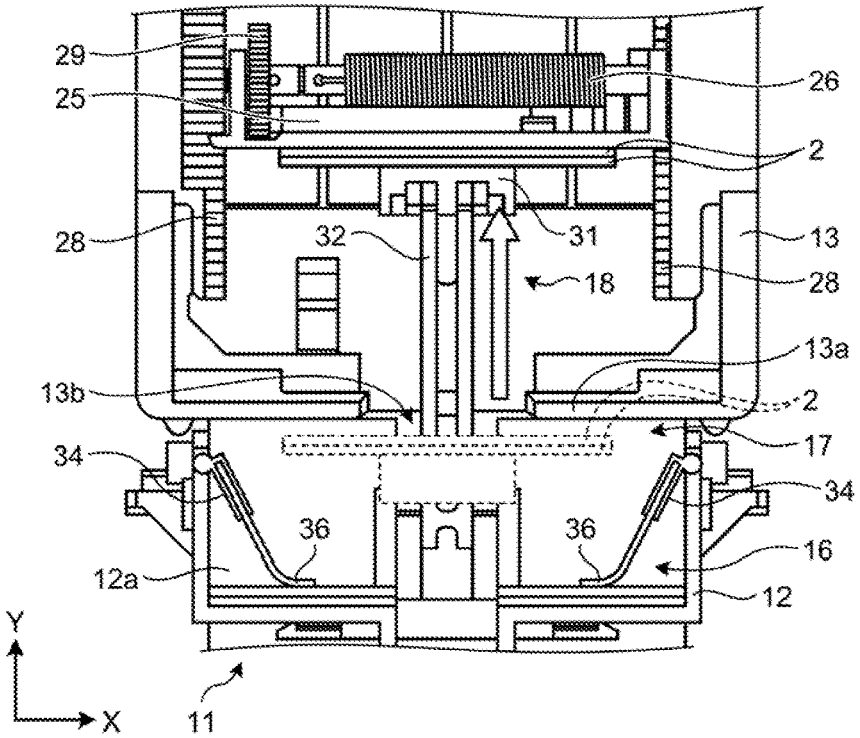
FIG. 7A is a plan view illustrating a state in which a plurality of banknotes accumulated in the temporary accumulation region is pushed into a storage by the push-in member in the banknote storage device according to the embodiment.
Figure 7B:
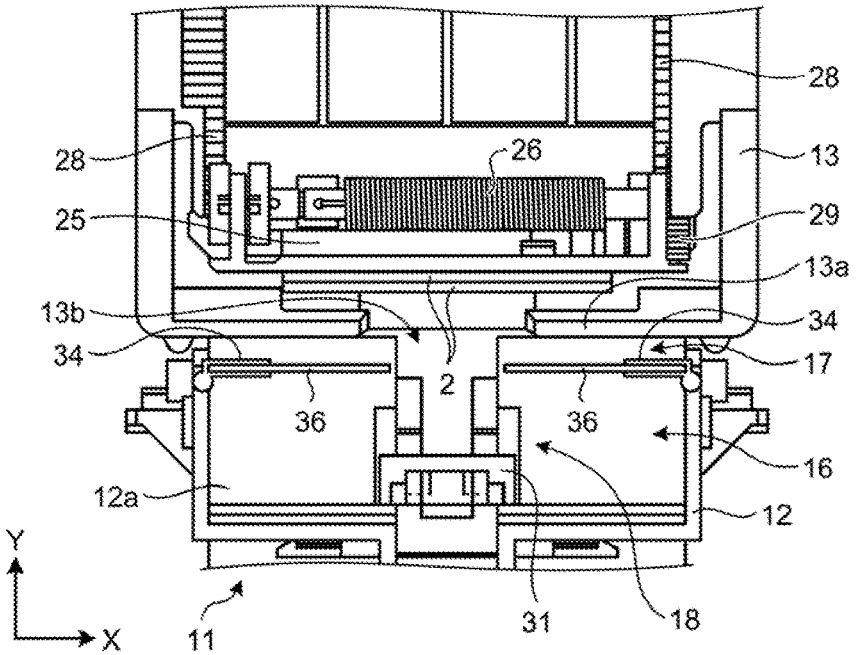
FIG. 7B is a plan view illustrating a state in which, after banknotes are stored in the storage, the push-in member returns to the standby position in the banknote storage device according to the embodiment.
Figure 8:
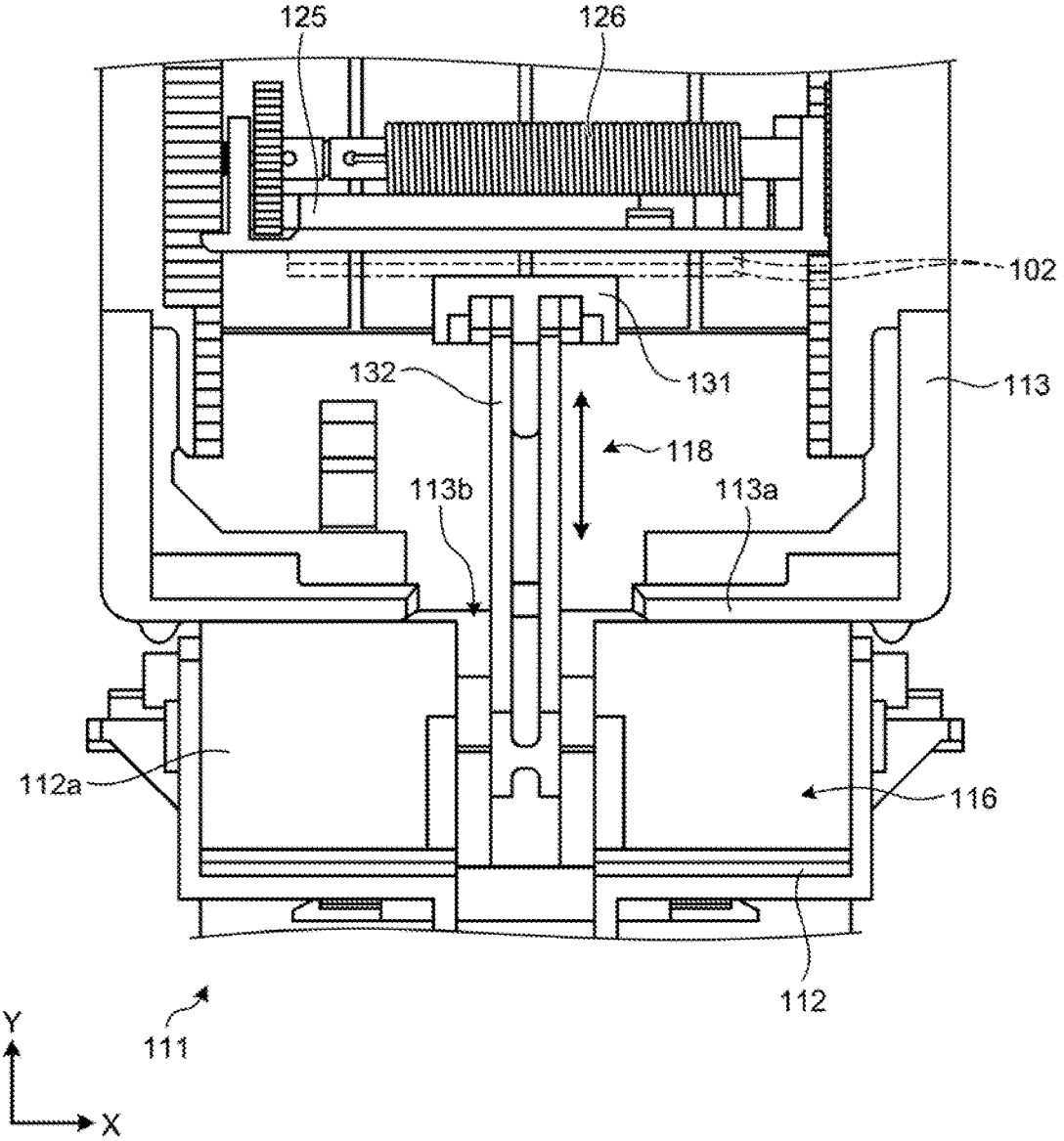
FIG. 8 is a plan view for describing a banknote storage device according to a related art of the present application.

FIG. 6F is a plan view illustrating a state in which a subsequent banknote 2 is loaded to the loading region 16 in the banknote storage device 11 according to the embodiment. FIG. 6G is a plan view illustrating a state in which a subsequent banknote 2 is moved to the temporary accumulation region 17 by the push-in member 31 in the banknote storage device 11 according to the embodiment. FIG. 6H is a plan view illustrating a state in which a subsequent banknote 2 is accumulated in the temporary accumulation region 17 by the push-in member 31 in the banknote storage device 11 according to the embodiment. FIG. 7A is a plan view illustrating a state in which a plurality of banknotes 2 accumulated in the temporary accumulation region 17 is pushed into the storage 13 by the push-in member 31 in the banknote storage device 11 according to the embodiment. FIG. 7B is a plan view illustrating a state in which, after the banknote 2 is stored in the storage 13, the push-in member 31 returns to the standby position in the banknote storage device 11 according to the embodiment.

Subsequently, as illustrated in FIG. 6F, a subsequent banknote 2 is loaded into the loading region 16 of the housing member 12. Similarly to the above-described operation, the push-in member 31 conveys the subsequent banknote 2, which is loaded to the loading region 16, to the temporary accumulation region 17 as illustrated in FIG. 6G.

The banknote 2, which is conveyed to the temporary accumulation region 17, is stacked on the banknote 2, which is held in the temporary accumulation region 17. In this way, as illustrated in FIG. 6H, the plurality of banknotes 2 in the temporary accumulation region 17, is held by the set of partition members 34 in an accumulated state. Moreover, the operations of steps S1 to S3 in FIG. 5 are repeated a plurality of numbers of times, whereby a plurality of banknotes 2 is accumulated in the temporary accumulation region 17.

Subsequently, after approximately five to ten banknotes 2 are accumulated in the temporary accumulation region 17, for example, the push-in member 31 advances from the standby position toward the second advance position. In this case, the set of partition members 34 is pivoted from the partition position toward the open position in synchronization with the operation of the push-in member 31 similarly to the above-described operation. Moreover, when the push-in member 31 moves to the first advance position, the push-in member 31 is pressed against the plurality of banknotes 2 accumulated in the temporary accumulation region 17. Subsequently, the push-in member 31 moves from the first advance position toward the second advance position to push the plurality of banknotes 2 in the temporary accumulation region 17 from the storage opening 13*b* toward the inside of the storage 13 (step S4 in FIG. 5). In this case, the set of partition members 34 stops continuously in a state of being moved to the open position.

When the plurality of banknotes 2 is pushed into the storage opening 13*b*, the plurality of banknotes 2 passes through the storage opening 13*b* together with the push-in member 31 advancing from the storage opening 13*b* into the storage 13, in a state in which the banknote 2 is folded into two parts at the center of the long side thereof. When the push-in member 31 advances from the storage opening 13*b* into the storage 13, the push-in member 31 is pressed against the pressing member 25 in a state in which the plurality of banknotes 2 is sandwiched between the push-in member 31 and the pressing member 25. In this way, when the banknote 2, which is pushed from the storage opening 13*b* in a state of being folded into two parts, is sandwiched between the push-in member 31 and the pressing member 25, the long side thereof returns to a straightly expanded state. Moreover, as illustrated in FIG. 7A, the push-in member 31 advances further to the second advance position in the storage 13 together with the pressing member 25 while resisting against the pressing force of the coil spring 26 that biases the pressing member 25.

After the push-in member 31 moves to the second advance position, the push-in member 31 retracts from the second advance position toward the standby position. When the push-in member 31 retracts from the second advance position, the pressing member 25 is moved together with the push-in member 31 by the pressing force of the coil spring 26, in a state in which the plurality of banknotes 2 is sandwiched between the push-in member 31 and the pressing member 25. Moreover, when the push-in member 31 retracts from the storage opening 13*b* toward the outer side of the storage 13, the pressing member 25 is pressed against the side wall 13*a* having the storage opening 13*b* by the pressing force of the coil spring 26. Due to this, the pressing member 25 stops in a state in which the plurality of banknotes 2 is sandwiched between the pressing member 25 and the side wall 13*a*. In this way, the banknotes 2 stored in the storage 13 are held by the pressing member 25 in an appropriately accumulated state.

When the push-in member 31 passes the first advance position and retracts toward the standby position, the set of partition members 34 is pivoted from the open position toward the partition position. Finally, as illustrated in FIG. 7B, the push-in member 31 returns to the standby position, and the set of partition members 34 returns to the partition position. In this way, the operation of storing the plurality of banknotes 2 accumulated in the temporary accumulation region 17 ends (step S5 in FIG. 5). After that, similarly, after the operations of steps S1 to S3 in FIG. 5 are repeated, the operations of steps S4 and S5 are performed.

The banknote storage method of the banknote storage device 11 according to the embodiment includes a first step and a second step. In the first step, the banknote 2 loaded to the loading region 16 of the housing member 12 is pushed into the temporary accumulation region 17 provided between the loading region 16 and the storage 13. In the second step, after the first step is repeated a plurality of numbers of times, the plurality of banknotes 2 accumulated in the temporary accumulation region 17 is stored in the storage 13. Moreover, in the first step, the plurality of banknotes 2 is collectively pushed from the loading region 16 into the temporary accumulation region 17. In this way, the processing time for storing the banknotes 2 in the storage 13 can be shortened further.

[Processing Time of Banknote Storing Operation]

The processing time for storing fifty banknotes 2, for example, in the storage 13 in the present embodiment by performing the above-described storing operation will be described. Here, the storing operation of the embodiment and the storing operation of a reference example, which is the related art of the present application, will be compared under a condition in which the moving speed of the push-in member 31 in the embodiment is identical to that of the reference example. In the embodiment and the reference example, it is assumed that a period for reciprocating the push-in member 31 between the standby position and the second advance position (that is, a period for returning the push-in member 31 to the standby position after the banknote 2 loaded to the loading region 16 is stored in the storage 13) is 500 (ms). Moreover, in the embodiment, it is assumed that a period for reciprocating the push-in member 31 between the standby position and the first advance position (that is, a period for returning the push-in member 31 to the standby position after the banknote 2 loaded to the loading region 16 is conveyed to the temporary accumulation region 17) is 200 (ms).

In the reference example, the banknotes loaded to the loading region are stored in the storage one by one. Due to this, in the reference example, when fifty banknotes are stored in the storage, the push-in member performs the operation of reciprocating between the standby position and the second advance position fifty times. Therefore, in the reference example, the processing time of the operation of storing fifty banknotes is 500 (ms)×50 (times)=25 (s).

In contrast, in the embodiment, when fifty banknotes 2 are stored in the storage 13, an operation of temporarily storing ten banknotes 2 in the temporary accumulation region 17 and then storing every ten banknotes 2 from the temporary accumulation region 17 in the storage 13 is performed as an example. In this case, the push-in member 31 performs the operation of reciprocating between the standby position and the first advance position fifty times and performs the operation of reciprocating between the standby position and the second advance position five times. Therefore, in the embodiment, the processing time is (200 (ms)×50 (times))+(500 (ms)×5 (times))=12.5 (s). In this way, according to the embodiment, it is possible to shorten the processing time for storing fifty banknotes 2 by approximately ½ as compared to the reference example. That is, in the embodiment, the processing time of the operation of storing fifty banknotes 2 shortens the operation time of the push-in mechanism 18 in the storing operation (that is, the processing time is shortened by shortening the moving distance of the push-in member 31).

In the present embodiment, an operation in which the banknotes 2 are stored in the loading region 16 one by one and the banknotes 2 are conveyed from the loading region 16 to the temporary accumulation region 17 one by one, and the plurality of banknotes 2 accumulated in the temporary accumulation region 17, is stored in the storage 13 is used. However, the storing operation is not limited to this operation. For example, an operation in which, after a plurality of banknotes 2 is loaded to the loading region 16, the plurality of banknotes 2 is collectively conveyed from the loading region 16 to the temporary accumulation region 17 may be employed. In this way, it is possible to further shorten the processing time of the operation of storing the banknotes 2.

In the present embodiment, although the operation in which, after the push-in member 31 conveys the banknotes 2 to the temporary accumulation region 17, the push-in member 31 retracts from the first advance position to the standby position, is used, the present invention is not limited to this operation. The operation in which the push-in member 31 returns from the first advance position to the standby position after conveying a predetermined number of banknotes 2 to the temporary accumulation region 17, may be omitted. In this case, an operation in which, immediately after the push-in member 31 conveys a plurality of banknotes 2 to the temporary accumulation region 17, the push-in member 31 advances from the first advance position to the second advance position to store the plurality of banknotes 2 accumulated in the temporary accumulation region 17 in the storage 13, may be employed. In this way, it is possible to further shorten the processing time of the operation of storing the banknotes 2.

Effects of Embodiment

The banknote storage device 11 according to the embodiment includes the housing member 12 having the loading region 16, the storage 13 adjacent to the housing member 12, and the temporary accumulation region 17 provided between the loading region 16 and the storage 13. Moreover, the banknote storage device 11 includes the push-in mechanism 18 that pushes the banknote 2 loaded to the loading region 16 into the temporary accumulation region 17 and pushes the plurality of banknotes 2 accumulated in the temporary accumulation region 17 into the storage 13. In this way, after the banknotes 2 are temporarily delivered from the loading region 16 to the temporary accumulation region 17 and a plurality of banknotes is accumulated in the temporary accumulation region 17, the banknotes 2 are stored from the temporary accumulation region 17 into the storage 13. As a result, the operation time of the push-in mechanism 18 is shortened, and the processing time for storing the banknotes 2 loaded to the loading region 16 in the storage 13, can be shortened.

The banknote storage device 11 according to the embodiment further includes one set of partition members 34 provided to be movable between, the partition position at which the partition member partitions the space between the loading region 16 and the temporary accumulation region 17, and the open position at which the partition member opens the space between the loading region 16 and the temporary accumulation region 17. In this way, the banknotes 2 accumulated in the temporary accumulation region 17, can be held by the set of partition members 34 at the partition position. Moreover, the set of partition members 34 moves to the open position whereby the partition member, can be prevented from interfering with the push-in operation of the push-in mechanism 18 and the movement of the banknote 2.

The set of partition members 34 of the embodiment moves from the partition position to the open position when the push-in mechanism 18 pushes the banknote 2 into the temporary accumulation region 17 in synchronization with the push-in mechanism 18. In this way, it is possible to simplify the mechanism that drives the set of partition members 34 and to reduce the size of the entire banknote storage device 11.

The storage 13 of the embodiment has the storage opening 13*b*, in which the banknote 2 is folded and pushed by the push-in mechanism 18. In this way, it is possible to prevent the banknote 2 stored in the storage 13 from being removed from the storage opening 13*b*.

The partition member 34 of the embodiment has the base end 35, which is provided so as to be pivotable, and the distal end 36, which is elastically deformable and is connected to the base end 35. Since the partition member 34 is provided so as to be pivotable, it is possible to easily realize an operation of holding the banknotes 2 in the temporary accumulation region 17 and retracting from the movement path of the banknote 2 pushed by the push-in mechanism 18. Furthermore, the partition member 34 is elastically deformed when making contact with the push-in mechanism 18 and the banknote 2, and the partition member 34 can be prevented from interfering with the push-in operation of the push-in mechanism 18 and the movement of the banknote 2.

The base end 35 of the set of partition members 34 of the embodiment is formed of a rigid material and the distal end 36 is formed of an elastic material. Since the base end 35 of the partition member 34 has rigidity, it is possible to elastically deform the distal end 36 and to enhance the stability of the pivoting operation of the base end 35.

The bottom plate 12*a* of the housing member 12 may be inclined in a horizontal direction so that the bottom plate 12*a* extends downward from the temporary accumulation region 17 toward the side wall 13*a* of the storage 13. According to this configuration, the banknote 2 in the temporary accumulation region 17 can be held close to the side wall 13*a* of the storage 13 and the stability of the holding state can be enhanced.

In the embodiment, although the banknotes 2 stored in the storage 13 are not recycled (circulated) inside the banknote handling device 1, the present invention is not limited to this configuration. For example, a discharge opening for discharging the banknotes 2 stored in the storage 13, may be formed in another side wall different from the side wall 13*a* in which the storage opening 13*b* is formed. In this case, the banknotes 2 discharged from the discharge opening of the storage 13, are used for recycling inside the banknote handling device 1.

According to an aspect of the paper sheet storage device disclosed in the present application, it is possible to shorten the processing time for storing a loaded paper sheet in a storage member.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A paper sheet storage device comprising:

a housing member having a loading region in which a paper sheet is loaded;

a storage member which is disposed to be adjacent to the housing member and in which the paper sheet is stored;

a temporary accumulation region provided between the loading region and the storage member so as to temporarily accumulate the paper sheet to be stored in the storage member;

a push-in mechanism that pushes the paper sheet loaded to the loading region, into the temporary accumulation region and that pushes a plurality of the paper sheets accumulated in the temporary accumulation region, into the storage member; and a set of partition members that are arranged in parallel between the loading region and the temporary accumulation region, and that are provided so as to be movable to a first position and a second position, the first position being a position at which the partition members partition a space between the loading region and the temporary accumulation region to allow the paper sheet accumulated in the temporary accumulation region to be held between the set of partition members and a peripheral wall of the storage member, and the second position being a position at which the partition members open the space between the loading region and the temporary accumulation region, wherein the set of partition members moves, in synchronization with the push-in mechanism, from the first position to the second position by pivotally moving toward the loading region in a direction opposite to a feeding direction of the paper sheet pushed in by the push-in mechanism, when the push-in mechanism pushes the paper sheet into the temporary accumulation region from the loading region.

2. The paper sheet storage device according to claim 1, wherein the storage member has a storage opening in which the paper sheet is folded and pushed by the push-in mechanism.

3. The paper sheet storage device according to claim 1, wherein the set of partition members includes a base end, which is provided so as to be pivotable, and a distal end, which is elastically deformable and is connected to the base end.

4. The paper sheet storage device according to claim 3, wherein the base end is formed of a rigid material, and the distal end is formed of an elastic material.

5. A paper sheet storage method comprising:

pushing a paper sheet loaded to a loading region of a housing member into a temporary accumulation region formed between the loading region and a storage member configured to store the paper sheet;

storing a plurality of the paper sheets accumulated in the temporary accumulation region in the storage member after repeatedly performing the pushing a plurality of numbers of times; and when the paper sheet loaded to the loading region is pushed by a push-in mechanism from the loading region to the temporary accumulation region, allowing a set of partition members arranged in parallel between the loading region and the temporary accumulation region to pivotally move toward the loading region in a direction opposite to a feeding direction of the paper sheet pushed in by the push-in mechanism, and allowing the paper sheet accumulated in the temporary accumulation region to move from a first position to a second position, the first position being a position at which the set of partition members partition a space between the loading region and the temporary accumulation region to hold the paper sheet between the set of partition members and a peripheral wall of the storage member, and the second position being a position at which the set of partition members open a space between the loading region and the temporary accumulation region.

6. The paper sheet storage method according to claim 5, further comprising:

pushing the plurality of paper sheets collectively from the loading region to the temporary accumulation region.

* * * * *